United States Patent [19]

Brophy

[11] Patent Number: 4,538,810

[45] Date of Patent: Sep. 3, 1985

[54] BASEBALL DISPENSER DEVICE FOR BATTING PRACTICE

[76] Inventor: Arthur M. Brophy, 2043 Madison St., Hollywood, Fla. 33020

[21] Appl. No.: 262,687

[22] Filed: Jul. 29, 1981

[51] Int. Cl.[3] ..... A63B 69/40

[52] U.S. Cl. ..... 273/26 D; 273/29 A; 124/50; 124/81

[58] Field of Search ..... 273/26 A, 26 D, 201, 273/29 A; 124/1, 50, 18, 81

[56] References Cited

U.S. PATENT DOCUMENTS 2,955,824 10/1960 Chanko ..... 124/50

2,955,923 10/1960 Chanko ..... 124/50

3,999,753 12/1976 Desilets ..... 273/201

*Primary Examiner*—Richard C. Pinkham

*Assistant Examiner*—T. Brown

*Attorney, Agent, or Firm*—Arthur M. Brophy

[57] ABSTRACT

A baseball dispensing device for practicing batting that includes a three tubular chute for retaining and delivering baseballs to a hitter. The center tube contains an electric driven motor which rotates a pair of discs which dispense baseballs at timed intervals releasing them to a central tube established at an incline to allow the dispensed ball to roll and strike a spring. The weight of the ball causes the spring to flex and upon reflex propels the ball upward vertically allowing a batter to swing into the ball. The center motor driven discs are equipped with a hole which when completing a rotation dispenses balls alternately to the delivery chute.

5 Claims, 3 Drawing Figures

BASEBALL DISPENSER DEVICE FOR BATTING PRACTICE

BACKGROUND OF THE INVENTION

This invention relates to devices for enabling a baseball player to practice striking a ball. Specifically, it relates to an original device for positioning a ball, particularly a baseball in a position desired by a batter and for automatically delivering succeeding balls to the same position after each ball is struck by the batter.

The important objective of the present invention is to provide a device which may be used by baseball players to create the ideal position for striking a baseball upward and outward with the full force and power necessary to develop repetitive skill in addressing a power blow. This form of practice is beneficial not only for beginners who are developing proper skill in delivering proper impact with the baseball but also for experienced players at various levels who wish to improve their judgement of proper body placement relative to the ball.

A number of mechanical devices have been used or proposed for enabling players of moving ball games, of which tennis and baseball are examples, to attain skill in hitting the ball. And such apparatus, as a rule are are truly useful after the batter has developed a proper swing, a combination of body posture, hand grip and attitude of blow delivery to the ball. Most machines of this type by various mechanical means hurl or propel a ball to the player at various intervals, velocities, angles, heights and under projectile turn which influences the travel of the ball to the batter(curve, slider, knuckleball sinker, and hook). This invention is not concerned with the development of experience in coping with balls delivered by hurling but rather a device to teach fundemental posture and proper contact with the ball at a point in the air in front of the batter. At timed intervals a ball is projected upward in front of the batter free and unencumbered by speed or curvature. The batter can strike a ball and recover to strike another ball thus developing speed and agility in recovery, proper stance, and practice an upward force striking of the ball. Since each ball is delivered upward at a relative constant height one of the variables of practice is controlled allowing instructive training, observation and coaching.

It is accordingly a primary objective of the invention to provide a device that is useful, particularly in the game of baseball, for practicing proper foot stance, body position, wrist action, and a combined attitude to proper striking of a baseball.

SUMMARY OF THE INVENTION

In Brief, these and other objects are attained by a device wherein a magazine(tubular), which is disposed in an inclined position, holds and supplies a number of baseballs. A pair of rotating discs, with a hole large enough to afford clearance for the baseballs, rotates perpendicular to the tubular opening thus allowing balls to alternately enter the common delivery chute for contact with the spring. When the ball makes contact with the spring it is flexed by the weight of the moving baseball and upon reflex projects the baseball upward for a distance allowing the batter to strike outward and under the baseball. A ball is delivered to the batter at timed intervals providing for recovery of the batter and appearance of the next ball.

BRIEF DESCRIPTION OF THE DRAWINGS

A better understanding of the invention will be gained from the following detailed description of the preferred embodiment.

Figure 1:
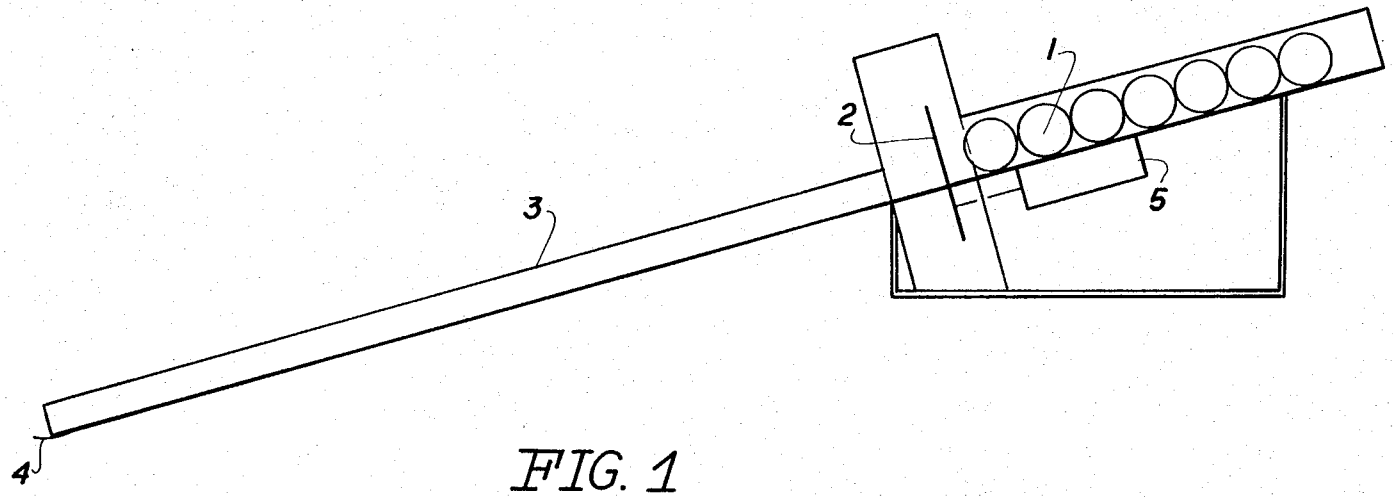
FIG. 1 is a side elevation of an apparatus according to the invention.

Referring first to FIG. 1, all of the elements of the invention can be seen, as viewed from a side view. The fundamental elements include a pair of tubular magazines holding the baseballs, numeral 1., rotating discs excentrically placed upon an axle driven by an electric motor. A ball delivery mechanism indicated generally by the numeral 2, controls the release of the base balls so that they are discharged one by one through alternate tubular magazines, to the inclined delivery chute numeral 3 and allow the ball to gravitate down the inclined chute and impinge upon the propelling spring, numeral 4.

Figure 2:
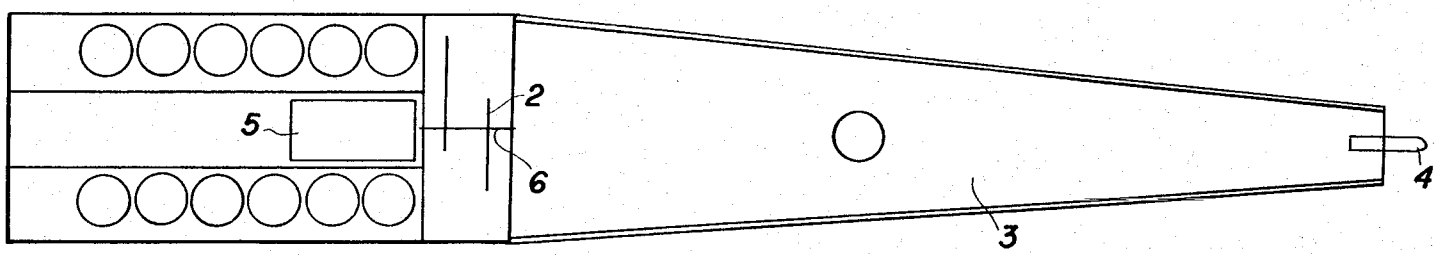
FIG. 2 is a view through the machine displaying the disc dispensing apparatus.

FIG. 2 shows a view of the machine from the top and all of the elements of the invention can be seen. Numeral 5., shows the positioning of the electric motor. Numeral 6., is the drive mechanism.

Figure 3:
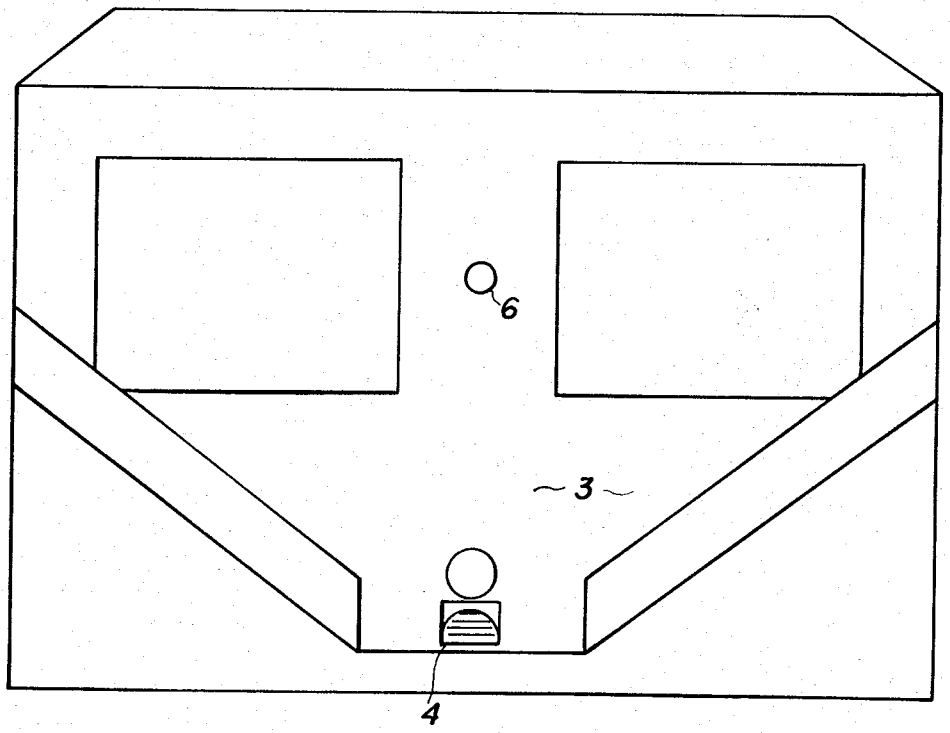
FIG. 3 is a frontal view showing ball delivery opening and inclined delivery plane to the spring apparatus.

FIG. 3 shows a view of the machine looking at the machine from the discharge view of the apparatus. Numeral 6., represents the axis of the driver shaft, numeral 3., the delivery chute and numeral 4., the propelling spring.

Although the invention has been described with reference to a specific embodiment, it should be understood that certain modification and variations within the skill of the art may be made wihout departing from the spirit and scope of the invention. Accordingly, the invention should not be taken as restricted to the precise embodiment disclosed.

What we claim is:

1. A ball dispensing machine comprising an elongated sloping ball container, said container having a ball entrance end, a ball exit end and a ball release means at said exit end for gravitationally receiving balls from said entrance end; a ball chute sloping downward and outward from said ball container and having one of its ends attached to said ball release means; spring means attached to the other end of said chute, said ball release means releasing balls singularly and at timed intervals to said chute and causing them to gravitationally roll down said chute to said other end to contact said spring means for deflection upward to be hit by a batter.

2. A ball dispensing machine as defined in claim 1, wherein said ball container has therein at least a pair of alleys, at least one alley for receiving balls through said entrance end of said container and said other alley containing a motor means, said motor means having a drive shaft extending therefrom and attached to said ball release means.

3. A ball dispensing machine as defined in claim 1, wherein said ball container has therein a pair of ball receiving alleys and a central motor receiving alley located between said ball alleys, a motor, said motor being contained in said central alley and having a shaft attached to said ball release means, said ball release means being contained in a front housing, said housing having openings communicating with said alleys and said chute.

4. A ball dispensing machine as defined in claim 3, wherein said ball release means is at least a pair of discs, said discs being spaced apart and eccentrically mounted on said shaft for alternately releasing balls through said openings and onto said chute.

5. A ball dispensing machine as defined in claim 1, wherein said chute has a pair of upstanding side walls and extends the width of said housing at its upper end and converges to a width at its lower end which will allow balls to pass between said side walls and onto said spring.

* * * * *